United States Patent [19]

Sudmann

[11] Patent Number: 5,075,141

[45] Date of Patent: Dec. 24, 1991

[54] DECORATIVE STRIPS FOR SHOWER PARTITIONS

[76] Inventor: Jürgen-Peter Sudmann, Dietrich-Bonhoeffer-Str. 18, 2902 Rastede, Fed. Rep. of Germany

[21] Appl. No.: 217,872

[22] Filed: Jul. 12, 1988

[30] Foreign Application Priority Data

Jul. 24, 1987 [DE] Fed. Rep. of Germany . 8710155[U]

[51] Int. Cl.[5] ..... A47K 3/22; B44C 3/12

[52] U.S. Cl. ..... 428/14; 4/612; 428/99; 428/122

[58] Field of Search ..... 4/605, 607, 608, 610, 4/612; 52/34, 35; 49/DIG. 2; 428/99, 122, 7, 14, 38, 358

[56] References Cited

U.S. PATENT DOCUMENTS

| | | | |
|---|---|---|---|
| 2,052,606 | 9/1936 | Comstock | 428/99 X |
| 2,063,585 | 12/1936 | Comstock | 428/99 X |
| 2,564,386 | 8/1951 | Webb | 428/122 X |
| 2,621,081 | 12/1952 | Mann | 428/31 X |
| 3,268,379 | 8/1966 | Baker | 428/913.3 X |
| 3,491,584 | 1/1970 | Selzer | 49/501 |
| 3,643,288 | 2/1972 | Olivari | 24/462 X |
| 3,709,767 | 1/1973 | Saiga | 428/9 |
| 3,868,804 | 3/1975 | Tantlinger | 52/206 X |
| 4,105,220 | 8/1978 | Pacific | 428/31 X |
| 4,182,495 | 1/1980 | Borgmeier et al. | 428/114 X |
| 4,204,376 | 5/1980 | Calvert | 52/35 X |
| 4,224,091 | 9/1980 | Sager | 49/DIG. 2 |
| 4,248,933 | 2/1981 | Katoh | 428/122 |
| 4,258,443 | 3/1981 | Baus | 4/610 X |
| 4,569,092 | 2/1986 | Baus | 4/612 X |
| 4,759,087 | 7/1988 | Zeilinger | 4/605 |

FOREIGN PATENT DOCUMENTS

| | | | |
|---|---|---|---|
| 0300332 | 1/1989 | European Pat. Off. | 4/612 |

*Primary Examiner*—Henry F. Epstein
*Attorney, Agent, or Firm*—Thomas W. Speckman; Douglas H. Pauley

[57] ABSTRACT

This invention relates to decorative strips for shower partitions. The decorative strips are constructed in the form of a circular section.

13 Claims, 5 Drawing Sheets

FIG. 1
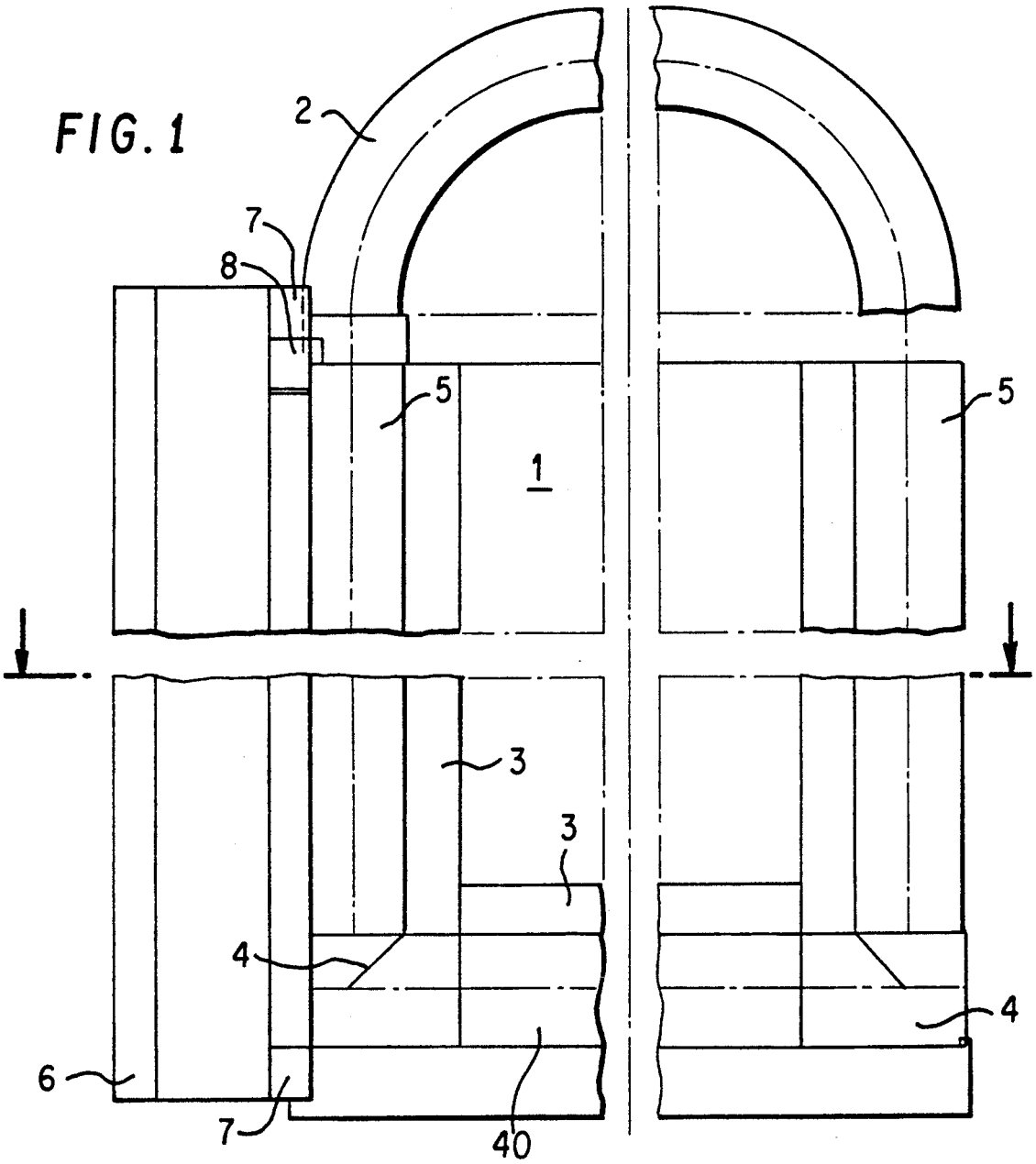
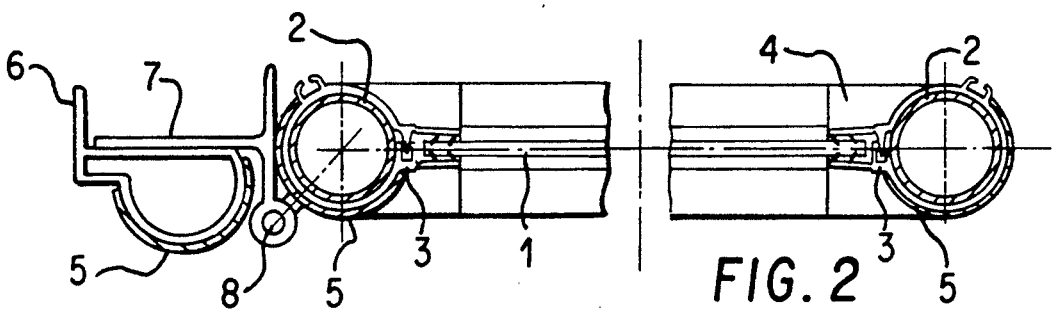
FIG. 2

DECORATIVE STRIPS FOR SHOWER PARTITIONS

BACKGROUND OF THE INVENTION

1. Field of the Invention

This invention concerns shower partitions with decorative strips, the frames of which have been formed from round profile sections.

2. Description of the Prior Art

Shower partitions are generally produced from aluminum profile frames with a filling of plastic or genuine glass. If the shower partition is supposed to correspond to special desires for colors, the extruded aluminum sections are coated with the corresponding colors before final assembly. This process is relatively expensive. It is less expensive to insert special decorative strips into reception grooves in the aluminum profile sections, or even to adhere the decorative strips directly onto the aluminum profile section. However, such decorative strips must be assembled at the factory. As a result, changing color formation or color by changing decorative profile sections is not possible by the ultimate consumer.

SUMMARY OF THE INVENTION

The problem solved by this invention is that of producing colored shower partitions after their manufacture and at any time. This is accomplished by decorative strips which can be produced from rolled metallic bands, preferably from extruded plastic, formed essentially in the form of a circular section. These decorative strips can then be assembled with the corresponding round framework profile section of the shower partition at the actual final location.

The application of the decorative strips is particularly easy if the circular section is somewhat larger than 180°, since the decorative strips then support themselves. If the wall strips of the shower partitions likewise have a corresponding construction, then the decorative strips can also be applied there as well. This is supported by the fact that the internal radius of the decorative strips can be somewhat smaller than the external radius of the corresponding shower partition profile section resulting in the decorative strips being pretensioned.

As an additional security, the decorative strip can be equipped on the internal side with an adhesive strip, or even be provided with notched projections on the ends. Such notched projections can face inwardly, generally toward the interior of the circular section of the decorative strip, or outwardly, generally in the direction away from the interior of the circular section of the decorative strip. In addition, it is possible, with a profile on the external side of the decorative strips, to change the appearance of the round profile strips. Through a high-value plastic foil attached to the outer side, the attraction value of the decorative strips in accordance with the invention can be further significantly increased.

BRIEF DESCRIPTION OF THE DRAWING

Embodiments of this invention, from which further inventive characteristics proceed, are shown in the drawings, wherein:

FIG. 1: A side view of a shower partition, to which the decorative strips are attached, in accordance with the invention;

FIG. 2: A cross section through the shower partition of FIG. 1, with the attached decorative strips;

DESCRIPTION OF PREFERRED EMBODIMENTS

Figure 3:
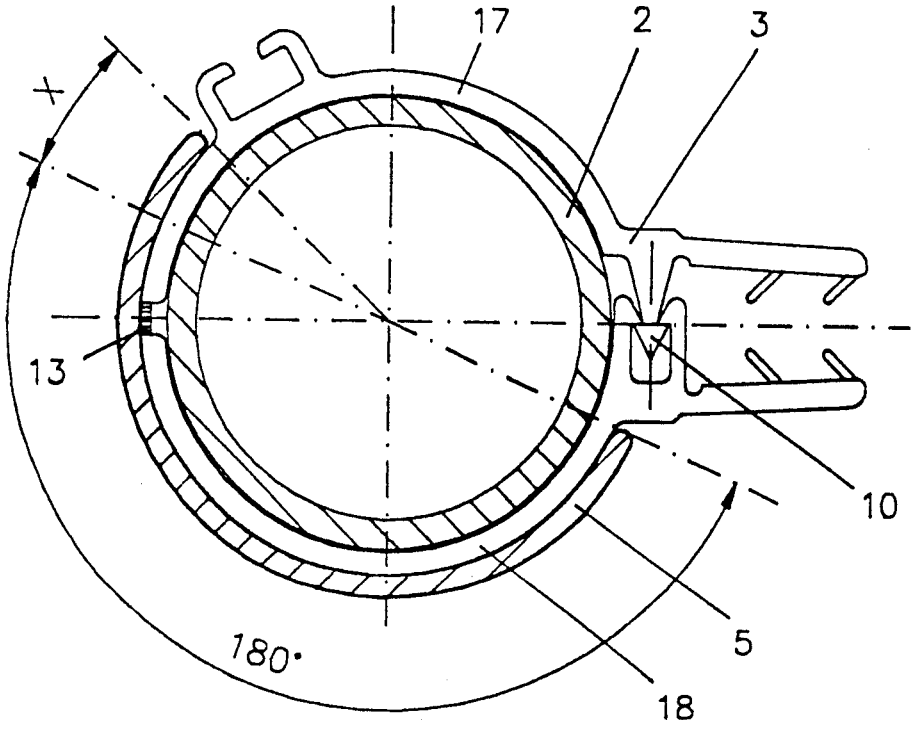
FIG. 3: A cross section through a framework profile section of the shower partition, with a decorative strip attached.

FIG. 1 shows a side view of a shower partition. It essentially comprises a bent tube (2), which with framework connectors (4) and a base part (40) is formed into a frame. The glass filling (1) is held by special frame profiles (3) extending from the tube (2). The connection to the wall is with hinges (8), an adjusting strip (7) and a wall strip (6). The decorative strips (5) in accordance with this invention are shown clipped onto the framework profile (3) and the wall strip (6).

FIG. 2 shows in cross section the shower partition, and how the decorative strips (5) are attached to the frame profiles (3) and the wall strip (6). Since the aperture angle of the decorative strips (5) is greater than 180°, they are securely held on by themselves.

In FIG. 3, the application of the decorative strip (5) is shown in an enlarged form. From this depiction, it is evident how the corresponding frame profile (3), comprising two half shells (17, 18) connected by the soft joint (13) with a snap connection (10), is mounted to the tube (2).

Figure 4:
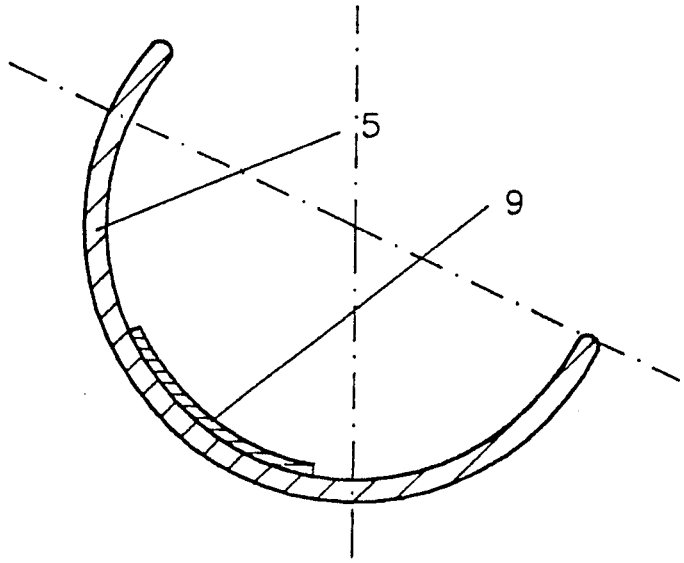
FIG. 4: A cross section through the decorative strip shown in FIG. 3, with an attached additional adhesive band.

In FIG. 4, a decorative strip (5) in accordance with one embodiment of this invention is additionally equipped with an adhesive strip (9). Adhesive strip (9) provides an additional security for a fitting.

Figure 5:
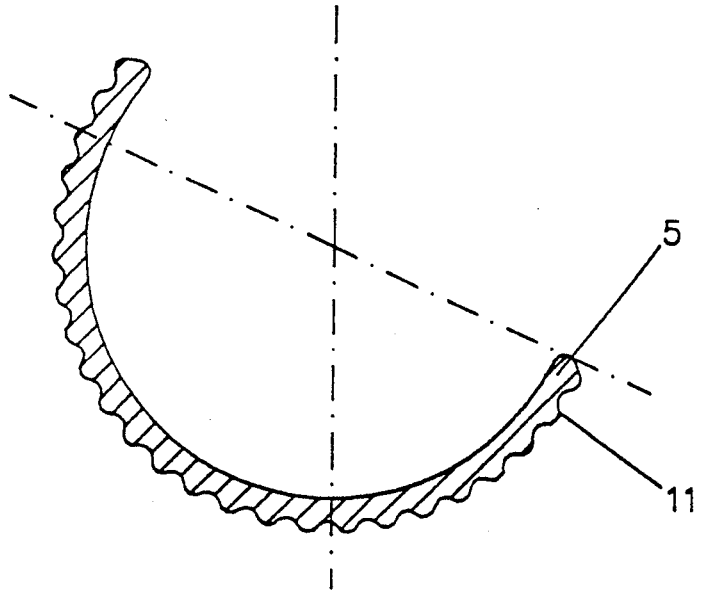
FIG. 5: A cross section through an external, finely profiled decorative strip.

FIG. 5 shows another embodiment of the decorative strip (5) which on the outer side has a fine profiling (11).

Figure 6:
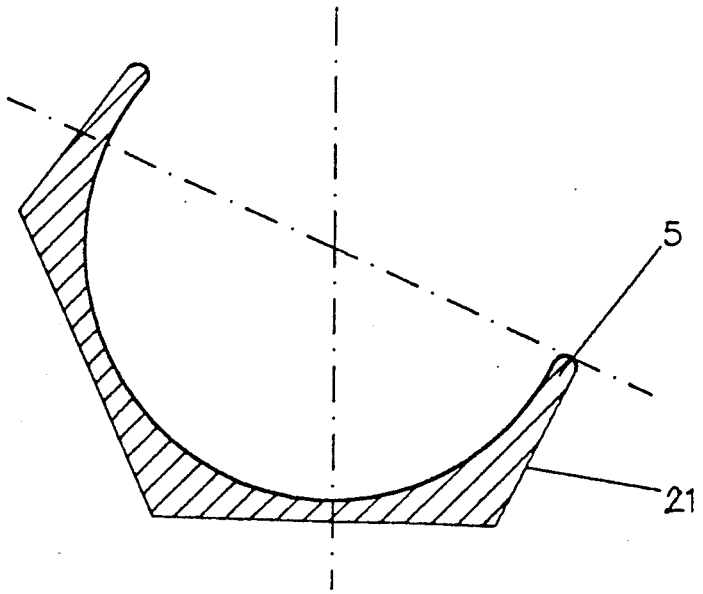
FIG. 6: A cross section through an external, prismatically profiled decorative strip.

FIG. 6 shows yet another embodiment of the decorative strip (5) with a different type of profiling (21).

Figure 7:
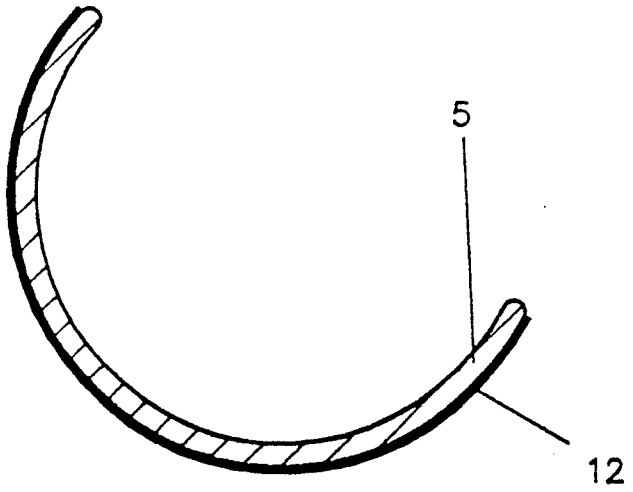
FIG. 7: A cross section through a decorative strip provided with plastic foil.

FIG. 7 shows the decorative strip (5) connected with a plastic foil (12), which is advantageously applied during the production of the decorative strip (5).

Figure 8:
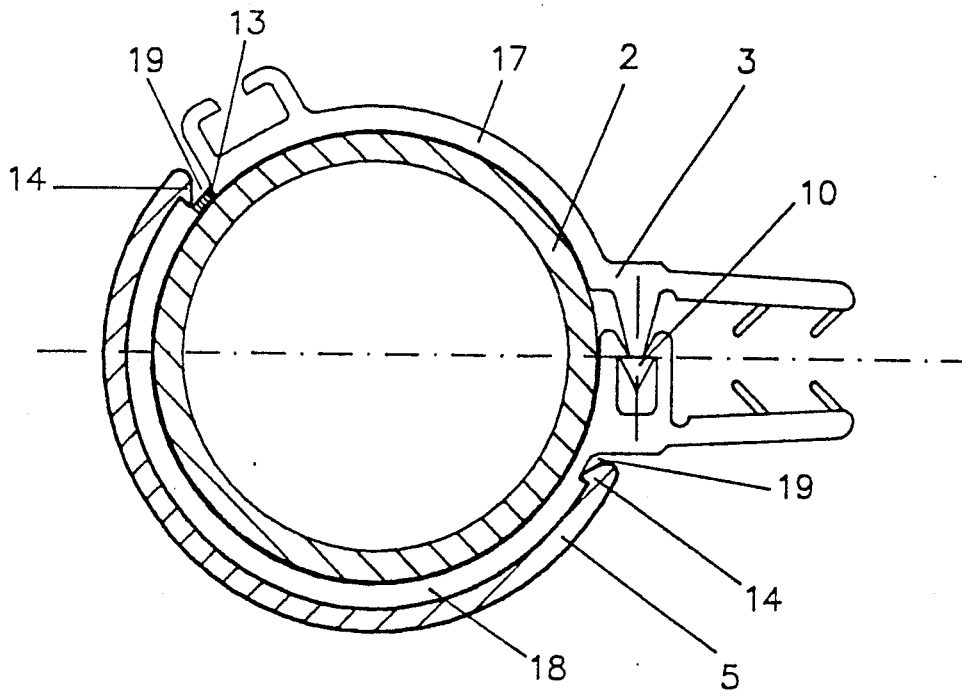
FIG. 8: A cross section through a framework profile section and a decorative strip having inwardly projecting notched projections.

FIG. 8 is another embodiment of the decorative strip (5) in the assembled condition, with the frame profile (3). The decorative strip (5) has two inwardly facing notched projections (14), which fit in recesses (19) of the frame profile (3).

Figure 9:
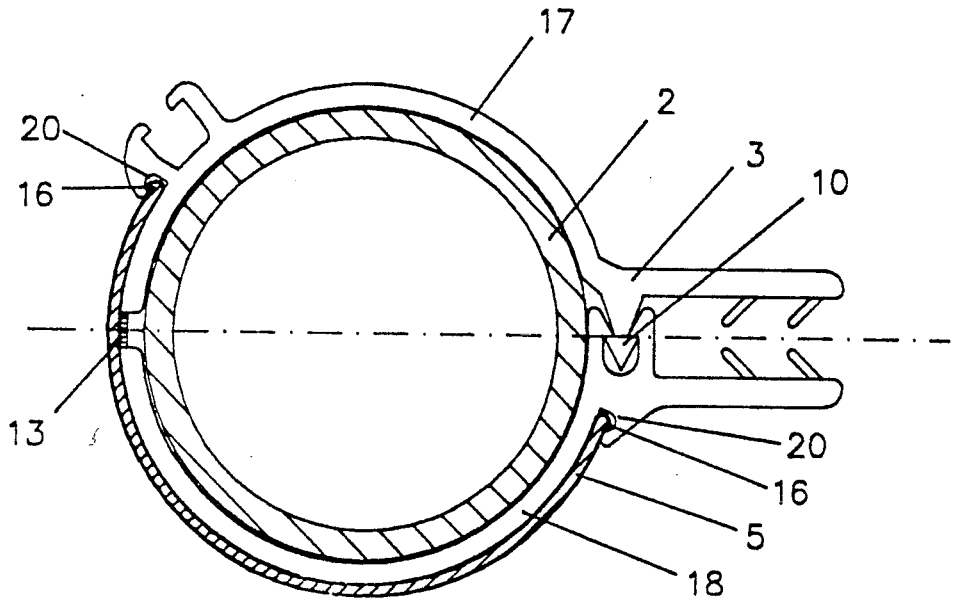
FIG. 9: A cross section through a framework profile and a decorative strip having outwardly projecting notched projections.

FIG. 9 shows yet another embodiment of the construction of the notched projections (16). Notched projections (16) project outward and fit in corresponding grooves (20) of the frame profile (3).

Figure 10:
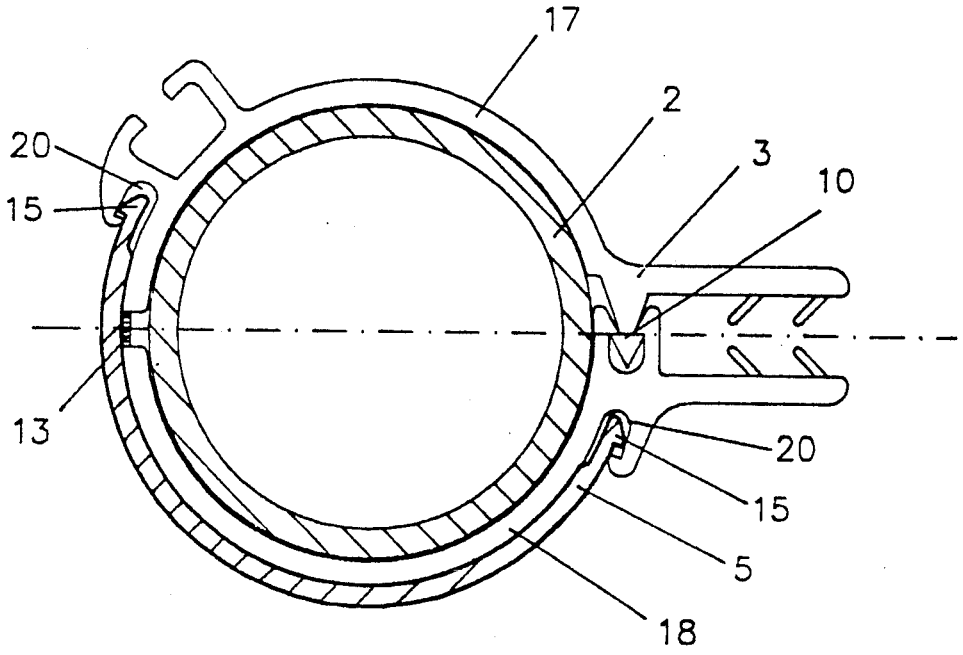
FIG. 10: A cross section through a framework profile and a decorative strip with resilient notched projections.

FIG. 10 shows a further embodiment of the construction of the decorative strip (5) in accordance with this invention. The decorative strip (5) is constructed with resilient hooks (15), which are snapped into grooves (20) of the frame profile (3).

I claim:

1. A shower partition comprising:

a U-shaped bent tube (2), a base, a plurality of framework connectors (4) connecting said base to each leg of said U-shaped bent tube (2) forming a frame; a frame profile (3) coaxially surrounding each said leg of said U-shaped bent tube (2), said frame profile (3) having a lengthwise protrusion which defines a channel for mounting a flat panel filling (1) in said channel between said legs; means for securing said frame to a plurality of walls; and a decorative strip (5) having an arcuate cross section clipped to an outer surface of said frame profile (3).

2. A shower partition in accordance with claim 1, wherein said arcuate cross section of each said decorative strip (5) is greater than 180°.

3. A shower partition in accordance with claim 2, wherein said decorative strips (5) have on each end a resilient hook (15) as a clipping element.

4. A shower partition in accordance with claim 3, wherein an adhesive strip (9) is centrally secured on an internal side of each said decorative strip (5).

5. A shower partition in accordance with claim 4, wherein each said decorative strip (5) has a profile (11, 21) on an external surface and a smooth profile on an internal surface.

6. A shower partition in accordance with claim 2, wherein an adhesive strip (9) is centrally secured on an internal side of each said decorative strip (5).

7. A shower partition in accordance with claim 1, wherein an adhesive strip (9) is centrally secured on an internal side of each said decorative strip (5).

8. A shower partition in accordance with claim 3, wherein each said decorative strip (5) has a profile (11, 21) on an external surface and a smooth profile on an internal surface.

9. A shower partition in accordance with claim 2, wherein each said decorative strip (5) has a profile (11, 21) on an external surface and a smooth profile on an internal surface.

10. A shower partition in accordance with claim 1, wherein each said decorative strip (5) has a profile (11, 21) on an external surface and a smooth profile on an internal surface.

11. A shower partition according to claim 1, wherein said means for securing said frame to said walls comprises a wall strip (6), an adjusting strip (7) secured longitudinally to said wall strip and hinges (8) connecting said frame to said adjusting strip.

12. A shower partition according to claim 1, wherein each end of said arcuate cross section of said decorative strips (5) forms one of an inward projection (14) and an outward projection (16).

13. A shower partition according to claim 1, wherein said panel filling is comprised of glass.

* * * * *